US005804797A

United States Patent [19]

Kaimoto et al.

[11] Patent Number: 5,804,797

[45] Date of Patent: Sep. 8, 1998

[54] PTC PLANAR HEATER AND METHOD FOR ADJUSTING THE RESISTANCE OF THE SAME

[75] Inventors: Takashi Kaimoto; Osamu Nakano; Masanori Saito; Koichi Inenaga, all of Fukuoka, Japan

[73] Assignee: Nippon Tungsten Co., Ltd., Fukuoka, Japan

[21] Appl. No.: 522,366

[22] PCT Filed: Jan. 27, 1995

[86] PCT No.: PCT/JP95/00095

§ 371 Date: Sep. 18, 1995

§ 102(e) Date: Sep. 18, 1995

[87] PCT Pub. No.: WO95/20819

PCT Pub. Date: Aug. 3, 1995

[30] Foreign Application Priority Data

| | | | |
|---|---|---|---|
| Jan. 31, 1994 | [JP] | Japan | 6-009932 |
| Jul. 7, 1994 | [JP] | Japan | 6-156156 |
| Nov. 16, 1994 | [JP] | Japan | 6-282145 |

[51] Int. Cl.[6] ..... H05B 1/02

[52] U.S. Cl. ..... 219/505; 219/548; 219/537; 219/483; 219/553; 219/543; 338/22 R

[58] Field of Search ..... 219/548, 528, 219/538, 537, 504, 505, 483–486, 553; 264/104, 209.3; 338/22 R, 22 SD

[56] References Cited

U.S. PATENT DOCUMENTS

| | | | |
|---|---|---|---|
| 4,151,401 | 4/1979 | Van Bokestal et al. | 219/508 |
| 4,885,457 | 12/1989 | Au | 219/548 |
| 5,006,696 | 4/1991 | Uchida et al. | 219/505 |
| 5,181,006 | 1/1993 | Shafe et al. | 338/22 R |
| 5,344,591 | 9/1994 | Smuckler | 252/511 |

FOREIGN PATENT DOCUMENTS

| | | |
|---|---|---|
| 48-7269 | 1/1973 | Japan . |
| 51-109461 | 9/1976 | Japan . |
| 55-105904 | 7/1980 | Japan . |
| 55-161202 | 10/1982 | Japan . |
| 63-10502 | 1/1988 | Japan . |
| 4177706 | 6/1992 | Japan . |
| 4273402 | 9/1992 | Japan . |
| 582305 | 4/1993 | Japan . |
| 5205905 | 8/1993 | Japan . |
| 5315053 | 11/1993 | Japan . |

*Primary Examiner*—Mark H. Paschall
*Attorney, Agent, or Firm*—Jordan and Hamburg

[57] ABSTRACT

A PTC planar heater according to the present invention is produced by bonding one or a plurality of PTC ceramic sheets, each having a pair of electrodes formed on the surface thereof, to an insulator. The electrode pairs are electrically connected in parallel by lead wires. An insulating elastic layer covers the electrodes to prevent warpage, electrical leaks, and shorting. A thickness of the PTC ceramic sheets equal to or greater than 0.5 mm prevents warpage. Resistance is adjusted by cutting conductive paths in the electrodes or by connecting predetermined portions of the electrodes. Further, in a PTC planar unit according to the present invention, a PTC thermistor element having a pair of electrodes formed thereon is in direct contact with one side of an insulation substrate, and a insulation substrate is mounted to the other side thereof.

12 Claims, 8 Drawing Sheets

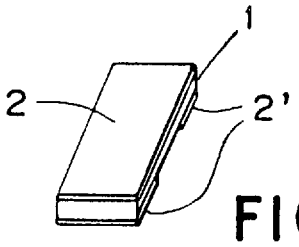
FIG. 11
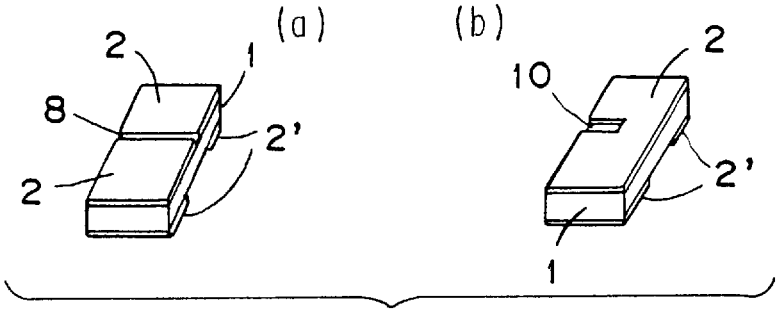
FIG. 12
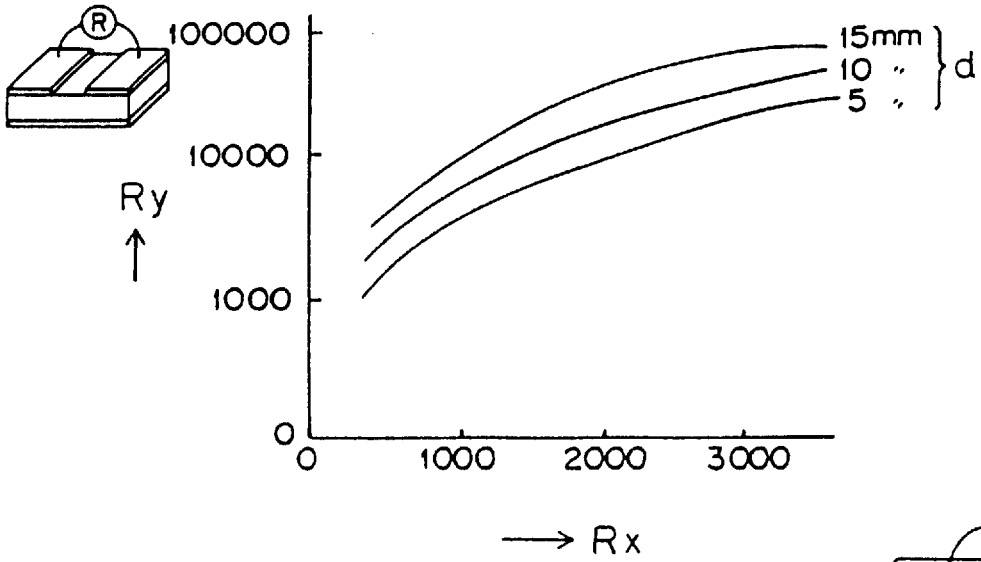
FIG. 13
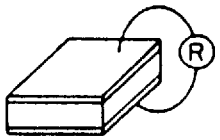

第 18 図

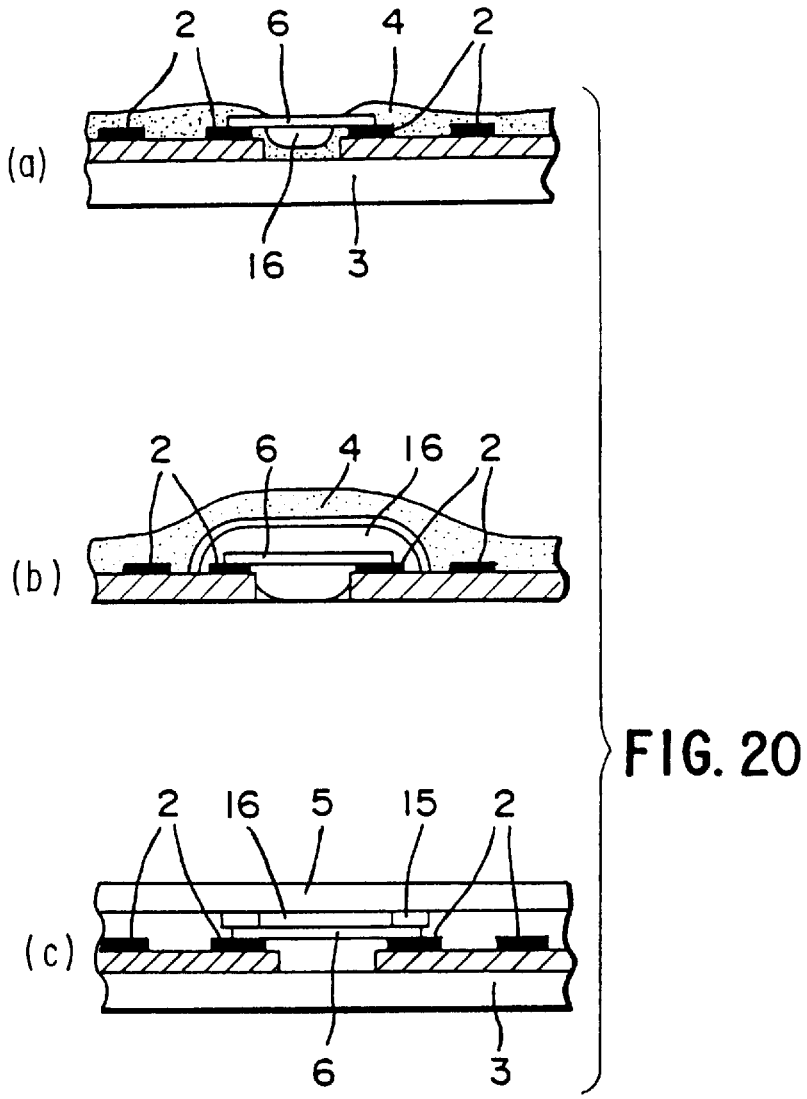
FIG. 20
FIG. 21 PRIOR ART
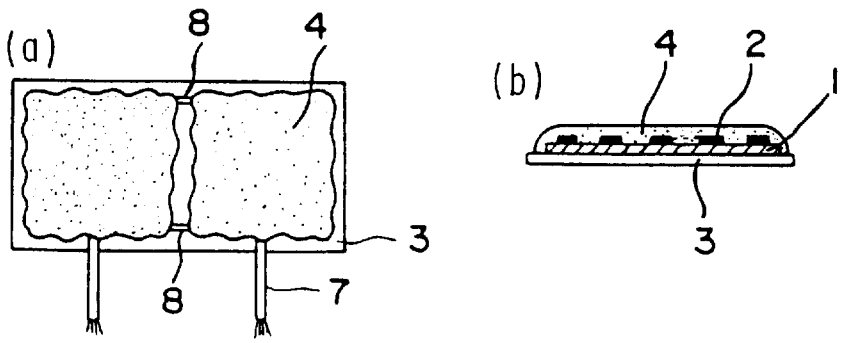

PTC PLANAR HEATER AND METHOD FOR ADJUSTING THE RESISTANCE OF THE SAME

BACKGROUND OF THE INVENTION

The present invention relates to a PTC planar heater used in applications related to aircraft, aerospace, automobile, shipping industries and others, wherein the heater must provide high output with limited weight and a method for adjusting the resistance of the same.

In general, PTC ceramic products have been manufactured by forming electrodes 2 on both sides of a PTC ceramic 1, sintered in the form of a rectangular sheet as shown in FIG. 24(*a*), for applying a voltage thereto. The output of the PTC ceramic 1 is not very high because of the limited surface area thereof. In order to increase the output, a metal releasing plate 17 is bonded thereto as shown in FIG. 24(*b*). According to this method, however, the thickness of the PTC ceramic 1 must be equal to or greater than a certain value and the heat releasing plate 17 must be quite large. This has resulted in a cost increase and problems in application where a limit is put on the weight.

Further, the increased output is limited to no-wind conditions, as the increase of the heat releasing coefficient is limited.

According to Japanese Unexamined Utility Model Publication No. Sho 55-105904, as shown in FIG. 23, such problems are addressed by forming a PTC thermistor 1 in the form of a thin plate, forming a pair of electrodes 2 on one side thereof, and causing the release of heat on the surface of a heat releasing plate 17 through an insulated substrate 3. This allows the output per unit area to be successfully increased.

However, in the structure disclosed in the above-described Japanese Unexamined Utility Model Publication No. Sho 55-105904, the PTC ceramic is sensitive to the atmosphere during sintering. This creates the problem that the resistance of the PTC ceramic significantly varies during mass production, which leads to the possibility of cost increases.

Further, the formation of the electrodes on one side of a thin plate can result in warping after printing and sintering.

Conventional methods for adjusting the resistance of such a device include the method disclosed in Japanese Unexamined Patent Publication No. Sho 51-109461, wherein an auxiliary electrode is formed on the rear side of a PTC thermistor substrate. According to this method, however, the surface area must be subjected to a significant change to accommodate the auxiliary electrode. This involves complicated techniques which reduce the feasibility of this method.

Further, in the case of the device disclosed in the above-described Japanese Unexamined Utility Model Publication No. Sho 55-105904, as shown in FIG. 22, resistance rapidly increases as a result of self-heating when a rush current Imax flows after the application of a voltage to attenuate the current therethrough which reaches a very low value of I0 when thermal equilibrium is reached. However, if the PTC thermistor is deteriorated by the conditions of the environment wherein the heating device is installed, the current is increased again as indicated by the curve (OS) in the thermal equilibrium wherein it should be low. This results in an overcurrent which creates an extremely dangerous state which can be triggered by as little as a spark from the PTC. Although a current fuse may be electrically connected in series to avoid this, this can increase the cost while still leaving the possibility of an accident if a current continues to flow at a level below the fusing current.

FIG. 21(*a*) and FIG. 21(*b*) show another conventional device wherein two PTC thermistors 1, having electrodes 2 on one side thereof, are connected together by a conductive connection portion 8 and are coated with an insulating film 4. This device breaks down under the application of a voltage of 520 V. When the breakdown occurs, sparks are generated and the resin and the like which encapsulates the device burns.

SUMMARY OF THE INVENTION

It is a first object of this invention to provide a PTC planar heater having a structure which is subject to less variation of resistance and less possibility of warpage in spite of the sheet-like shape, and a method for adjusting the resistance thereof.

It is a second object of the invention to provide a PTC planar heater wherein an overcurrent fusing portion is provided between PTC thermistors to prevent accidents such as uncontrolled operations and sparking.

In order to accomplish the first object, according to the present invention, there is provided a PTC planar heater wherein one or a plurality of sheet-like PTC ceramics, having a pair of electrodes formed on the surface thereof, are bonded to an insulator. If a plurality of PTC ceramics are provided, electrodes having the same polarity are electrically connected in parallel formation. Further, an insulating elastic layer is formed on the surface on which the electrodes are formed to prevent warpage, electrical leak, and shorting. The thickness of the sheet-like PTC ceramic is made equal to or greater than 0.5 mm to prevent warpage after printing and sintering.

According to the method for adjusting the resistance of the present invention, the resistance between the electrodes of the PTC ceramics of the above-described PTC planar heater is adjusted by cutting the conductive paths of the electrode patterns or by connecting, soldering or the like, predetermined positions on the conductive paths which have been cut in advance.

According to the present invention, a planar heater is provided by employing a structure wherein one or a plurality of sheet-like heater elements, having a pair of electrodes provided on the surface thereof, are bonded to a sheet-like insulator. Further, a heater having a large heat releasing area is obtained by parallel-connection of electrodes having the same polarity as the plurality of heater elements.

The present invention allows heaters having a large heat releasing area to be easily manufactured. In addition, although PTC ceramics are generally subjected to significant variation in resistance thereof, the present invention makes it possible to manufacture heaters with uniform characteristics at a high yield by allowing different values of resistance to be combined. By making the thickness of a sheet-like PTC ceramic equal to or greater than 0.5 mm, warpage after printing and sintering can be effectively prevented. Further, a heater can be provided with a uniform rush current through the adjustment of resistance achieved by cutting the conductive paths of the electrode patterns or by connecting, soldering or the like, predetermined positions on the conductive paths which have been cut in advance.

The possibility of a fire or the like is avoided, even if such functions fail and an accident occurs, by employing a nonflammable and arc resistant material in areas surrounding positions where sparking can occur.

In order to achieve the second object, according to the second aspect of the invention, an overcurrent fusing portion is provided between PTC thermistor elements to prevent accidents such as uncontrolled operations and sparking, and an arrangement is made which prevents sparks and flames from flying out from the device even when such a function does not work.

According to the present invention, an insulating substrate is provided on both sides of the PTC thermistor elements, especially in areas which are subjected to arcing and sparking. Further, the overcurrent fusing portion between PTC thermistor elements provides an advantage in that accidents, such as uncontrolled operations and sparking, are prevented, and sparks and flames do not fly out from the device even when such a function does not work. Further, a vacant space is provided around the overcurrent fusing portion to prevent any temperature rise at the overcurrent fusing portion from being delayed. This is advantageous in that no time-lag occurs in the fusing operation against an overcurrent and in that no variation occurs in the fusing position and fusing current, which leads to stable operation.

BRIEF DESCRIPTION OF DRAWINGS

FIG. 11 is a back perspective view of the embodiment shown in FIG. 10.

FIG. 12 is a perspective view showing another example of the method for adjusting resistance employed in the embodiments of the present invention.

FIG. 13 is a graph showing the relationship between the resistance obtained by forming electrodes on both sides and the resistance obtained by forming a pair of electrodes on one side.

FIG. 14(*b*) is a sectional view of a PTC planer unit according to the present invention.

FIGS. 20(*a*), 20(*b*), and 20(*c*) are sectional views of a PTC planar unit having a vacant space at an overcurrent fusing portion according to the present invention.

FIG. 21(*a*) is a front view of a conventional PTC heater unit.

FIG. 21(*b*) is a sectional view of a conventional PTC heater unit.

FIG. 24(*b*) is a sectional view of the heater unit.

DETAILED DESCRIPTION OF THE INVENTION

The present invention will now be described in detail with reference to the preferred embodiments thereof as shown in the accompanying drawings.

A first embodiment of the invention will now be described.

Figure 1:
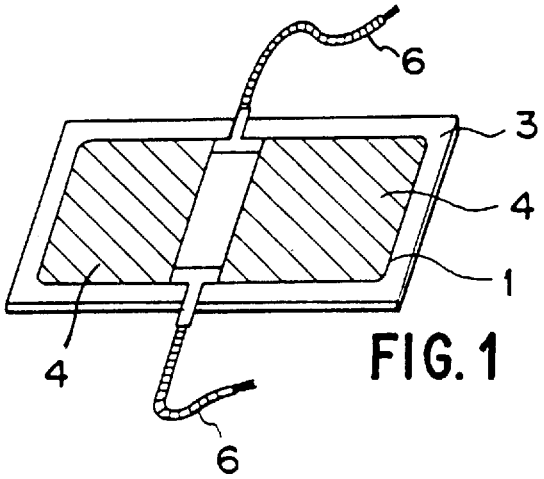
FIG. 1 is a perspective view showing an embodiment of a PTC planar heater according to the present invention.
Figure 2:
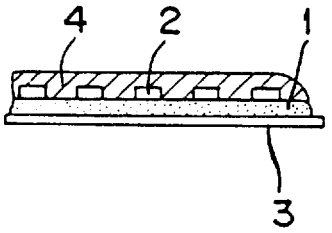
FIG. 2 is a sectional view of a part of FIG. 1.
Figure 3:
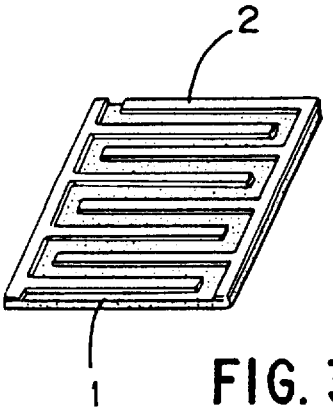
FIG. 3 is a perspective view showing the patterns of electrodes of a PTC ceramic according to the present embodiment.
Figure 4:
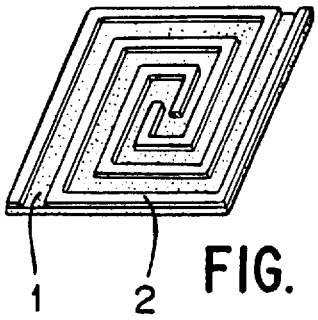
FIG. 4 is a perspective view showing another example of the patterns of electrodes.

FIG. 1 is a perspective view showing the first embodiment, and FIG. 2 is a sectional view showing a part of the first embodiment. Two PTC ceramics 1 which have a Curie point of 220° C. and are each 400 mm×40 mm×1 mm in dimension are obtained by sintering a green molded element are using extrusion molding, press molding, or the like. As shown in FIG. 3, a pair of electrodes 2 are formed on a surface of the PTC ceramics 1. The electrodes 2 may be arrayed in a form of a comb as shown in FIG. 3. The patterns may also be spirally arrayed as shown in FIG. 4. The sheet-like PCT ceramics 1 are bonded to an alumina substrate 3 having dimensions of 50 mm×100 mm×0.6 mm. The substrate 3 is formed of other ceramic materials having high thermal conductivity such as MgO, AlN, and SiC. Further, an insulation resistor is formed on a rear side of the substrate by electrically connecting lead wires 6 thereto. When an alternating voltage of 100 V is applied to the resultant heater, a steady output of 40 W is obtained. The weight of the heater was 31 grams.

Figure 5:
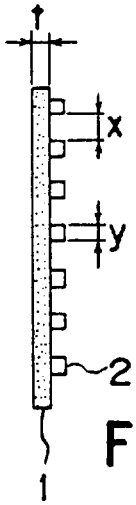
FIG. 5 is a sectional view of a PTC ceramic element according to the present invention.
Figure 6:
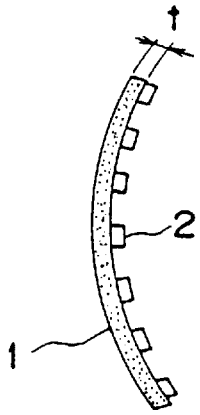
FIG. 6 is a sectional view for explaining warpage of a PTC ceramic element.

The lead wires 6 are easily and reliably bonded using a conductive adhesive or by means of soldering. An insulating elastic layer 4 is bonded to the surface on which the electrodes 2 are to prevent damage associated with heating and cooling. Since the electrodes 2 are formed along one side of the sheet-like PTC ceramic 1, warpage occurs as shown in FIG. 6 as a result of the contraction of the electrodes 2 during sintering. Such deformation during the formation of the electrodes can be avoided by making a thickness of the PTC ceramics 1 equal to or greater than 0.5 mm. The relationship between the thickness t and warpage was studied using the configuration shown in FIG. 5 with the electrodes formed at intervals x of 3 mm each and a width y of 2 mm. As a result, as is apparent from the Table 1 below, there is substantially no warpage where the thickness is equal to or greater than 0.5 mm.

TABLE 1

| No. | Thickness (mm) | Warpage (mm) |
|---|---|---|
| 1 | 0.1 | 0.5 |
| 2 | 0.3 | 0.3 |
| 3 | 0.5 | 0 |
| 4 | 0.7 | 0 |
| 5 | 0.9 | 0 |

Further, the surface on which the electrodes are formed is prone to contamination and damage and, in addition, electrical leak and shorting associated thereto. Such damage and contamination can be avoided through a reduction in the thermal stress, which is provided by bonding the insulating elastic layer 4 as described above. The insulating elastic layer 4 is formed of a material such as silicon resin and epoxy resin, which has excellent anti-heat and insulating properties. The use of silicon resin doubles the break down voltage when compared to a device wherein the insulating elastic layer 4 is not bonded.

A second embodiment of the present invention will now be described.

Figure 7:
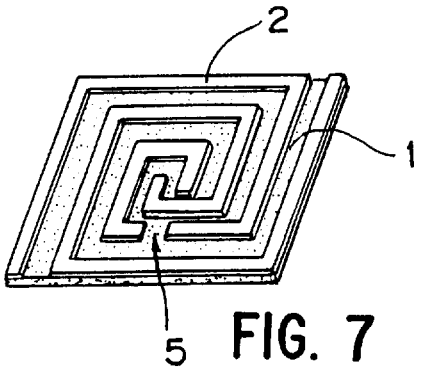
FIG. 7 is a perspective view showing an example of a method for adjusting resistance.

The resistance of the configuration as shown in FIG. 4 was measured at 1 KΩ. Since a desired resistance is in the range 1.5 to 2.5 KΩ, the pattern is cut in at a position 5, which is 20 mm away from the center as shown in FIG. 7. This results in a resistance of 1.6 KΩ which is within the proper range. When an alternating voltage of 100 V is applied to one heater with such an arrangement, a rush current is 0.23 A, which is also within the proper range. The temperature distribution was in the range of ±2° C. which causes no substantial problem.

A third embodiment of the present invention will now be described.

Slurry is obtained by adding PVB (polyvinyl butyral) and ethanol as binders to powder having a composition of $Ba_{0.8}Pb_{0.2}TiO_3+0.001Y_2O_3+0.005SiO_2+0.005MnO_2$. The resultant slurry is subjected to a doctored blade process to obtain a green sheet having a thickness of 0.6 mm. The sheet is sintered in the atmosphere at 1350° C. for one hour and, after printing and drying electrodes in the form shown in FIG. 4, baking is performed at 650° C. for 20 min. The resistance is measured across 100 sheets of elements thus obtained. Resistance within the range of 300 to 1500 Ω is obtainable for each sheet.

A fourth embodiment of the present invention will now be described.

Figure 8:
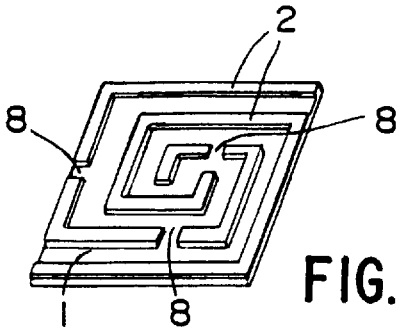
FIG. 8 is a perspective view of another embodiment of a PTC ceramic element according to the present invention.
Figure 9:
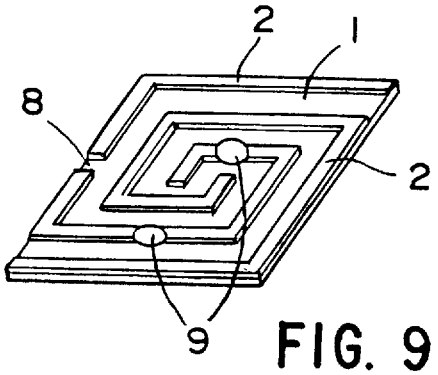
FIG. 9 is a perspective view showing an example wherein the cut portions in the embodiment shown in FIG. 8 are connected.

As shown in FIG. 8, patterns having cut portions 8 are formed on a sintered element obtained by operations similar to those in the third embodiment, and resistance is measured across the element. Resistance has been found to be within the range of 1000 to 3000 Ω for each sheet. Then, as shown in FIG. 9, the cut portions 8 are electrically connected at one to three locations, depending on the resistance, using connecting portions 9 which are conductive adhesives or solders. As a result, the resistance falls within the range of 1000 to 1300 Ω for each sheet.

A fifth embodiment of the present invention will now be described.

Figure 10:
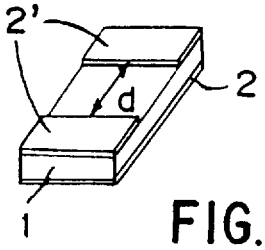
FIG. 10 is a perspective view of another embodiment of a PTC ceramic element according to the present invention.

Slurry is obtained by adding PVA (polyvinyl alcohol) as a binder to powder having a composition of $Ba_{0.8}Pb_{0.2}TiO_3+0.001Y_2O_3+0.005SiO_2+0.005MnO_2$. Then, the slurry is granulated into a powder by using a spray dryer. The resultant powder is molded into a rectangular form as shown in FIG. 10 and sintered in the atmosphere at 1350° C. for one hour into a sintered element. After printing and drying electrodes 2 and 2' as shown in FIGS. 10 and 11, baking was performed at 650° C. for 20 min. In test resistances were measured across 100 sheets of elements thus obtained. Resistance within the range of 500 to 1500 Ω is obtainable for each sheet. Then, a cut portion 8 as shown in FIG. 12(*a*) or a notch portion 10 as shown in FIG. 12(*b*) was selected and processed depending on the resistance. As a result, a resistance in the range of 1200 to 1500 Ω is obtainable for each sheet.

Although an example has been shown wherein a cut portion 8 as shown in FIG. 12(*a*) or a notch portion 10 as shown in FIG. 12(*b*) is formed after an electrode is formed to cover the entire surface of the element, an alternative method may be employed wherein the electrode 2 is cut in advance as shown in FIG. 12(*a*), and the number of the bonding portions 9 (not shown) is increased as shown in FIG. 12(*b*). Cutting may be performed using a laser or a file, an appropriate method being selected considering cost, workability and the like. On the other hand, the bonding portion can be processed using an appropriate method, other than the use of a conductive adhesive, selected from soldering, brazing, flame spraying, welding, and sputtering considering the process employed for lead connection, the cost and the Curie point of the element.

A sixth embodiment of the present invention will now be described.

FIG. 13 shows the result of a study on the relationship between varying distances d between the electrodes of a PTC ceramic obtained in a manner similar to that in the fifth embodiment (See FIG. 10). FIG. 13 shows the resistance obtained when electrodes are formed on the entire surface of both sides (the configuration shown in FIG. 24(*a*)) along the horizontal axis and the resistance obtained when a pair of electrodes are formed on one side (the configuration shown in FIG. 10) along the vertical axis using a logarithmic scale. As is apparent from FIG. 13, although the resistance is not proportionate to an integer multiple of the distance, the relationship can be described as certain curves in the form of parabolas. Thus, it is apparent that the resistance can be adjusted by adjusting the distance between the electrodes.

A seventh embodiment of the invention will now be described.

Figure 14:
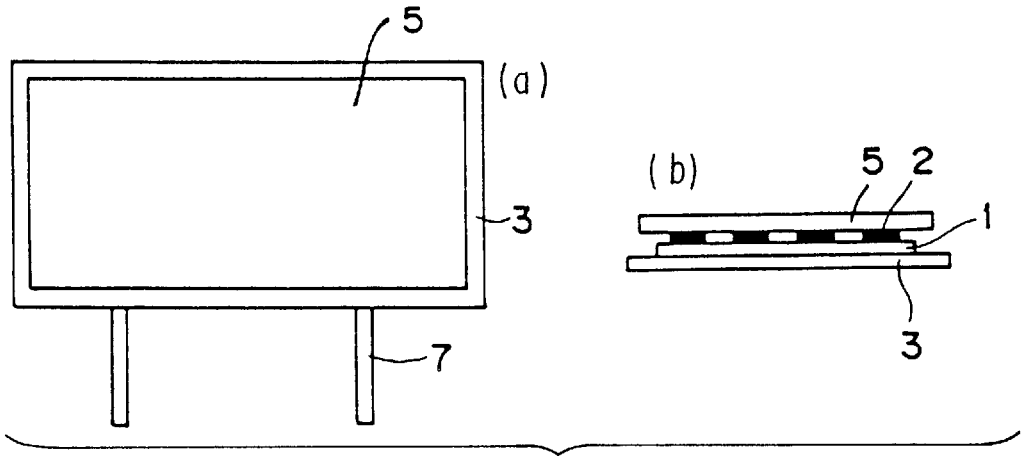
FIG. 14(*a*) is a front view of a PTC planer unit according to the present invention.
Figure 15:
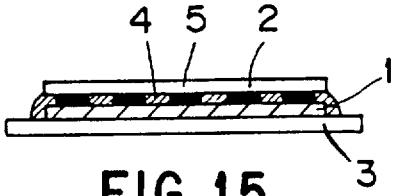
FIG. 15 is a sectional view of a PTC planar unit coated with an insulated film according to the present invention.

The PTC planer unit, shown in FIGS. 14(*a*) and 14(*b*), is a seventh embodiment of the present invention wherein a PTC ceramic 1 is directly bonded to an insulation substrate 3 and electrodes 2 are formed thereon, wherein an insulation substrate 5 serving as a protective plate is bonded over the electrodes 2. As shown in FIG. 15, the insulation substrate 5 is bonded and insulation film 4 made of silicon resin or the like is interposed. As the insulation substrate 3, a so-called alumina substrate, mainly composed of alumina is preferable in terms of anti-heat properties, strength and weight. However, the invention is not limited thereto, and the substrate may be formed from any material such as mica, magnesia, aluminum nitride, epoxy, and silicon, as long as it is insulating, heat-resistant, and in the form of a sheet.

On the other hand, the insulation substrate 5, which may be subjected to arcing, sparking and the like, should preferably be formed of a mica when anti-arcing properties are considered. However, the invention is not limited thereto, and the substrate may be formed from materials such as magnesia, aluminum nitride, epoxy, and silicon as described above, as long as they are insulating, heat-resistant, and in the form of a sheet.

When a high voltage is applied to such units, the unit having the structure shown in FIGS. 14(*a*) and 14(*b*) broke down at 350 V while the unit having the structure as shown in FIG. 15 broke down at 500 V. Such a difference originates in the difference in the insulation between the electrodes. However, in either case, there was no generation of sparks or the like even though the front and rear insulation substrates had cracked.

Figure 16:
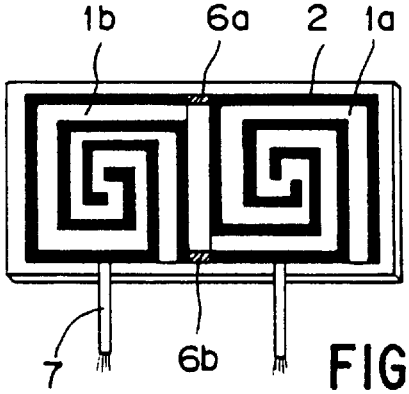
FIG. 16 is a front view of a PTC planar unit comprising two elements according to the present invention.
Figure 17:
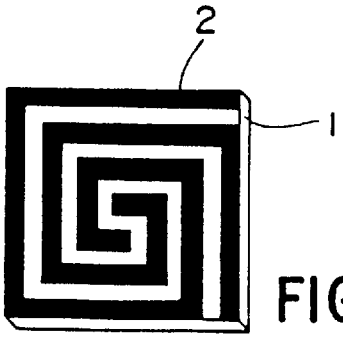
FIG. 17 is a front view of a PTC planar unit having spiral electrodes according to the present invention.
Figure 18:
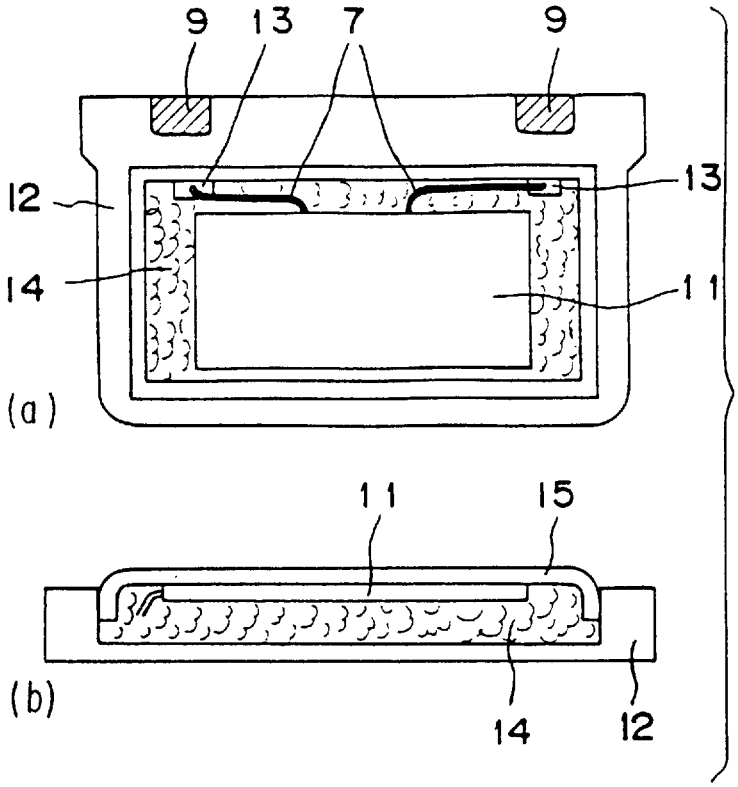
FIGS. 18(*a*) and 18(*b*) are sectional views of a heater incorporating a PTC planar unit according to the present invention.
Figure 23:
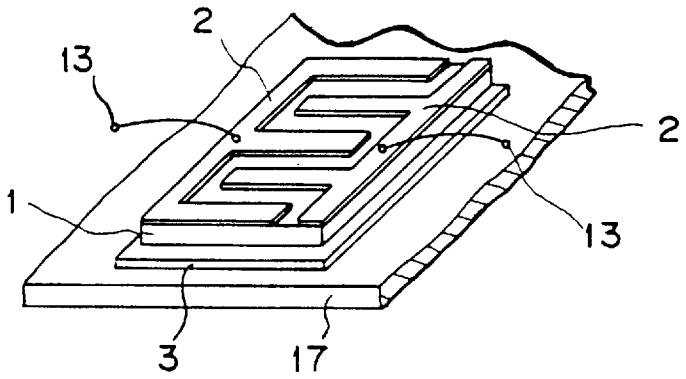
FIG. 23 PRIOR ART
FIG. 23 is a perspective view of a conventional PTC heater unit.
Figure 24:
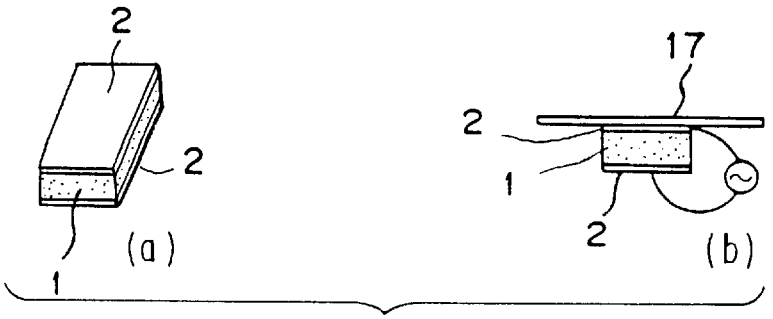
FIG. 24 PRIOR ART
FIG. 24(*a*) is a perspective view of an element of a conventional PTC heater unit.

When a plurality of conventional PTC units are used, as described with reference to FIGS. 23 and 24, conductive paths form between the PTC units using lead wire bonding portions 13. According to the present invention, such portions are replaced by overcurrent fusing portions 6*a* and 6*b* as shown in FIG. 16. Specifically, stainless wires are used which are 0.1–1.0 ϕ, preferably 0.3–0.5 ϕ, in thickness and 1–40 mm, preferably 3–10 mm, in length taking the specific resistance of the metal wires into consideration. With this configuration, when the PTC units are generating an overcurrent, the voltage concentrates at the overcurrent fusing portions 6*a* and 6*b*, which have a resistance higher than that of the electrodes. When the overcurrent flows further, the overcurrent fusing portions 6*a* and 6*b* are fused to protect the ceramic 1. By mounting two PTC ceramics having a pair of vortex-shaped electrodes 2 formed on the surface thereof as shown in FIG. 17, lead wires 7 can be taken out in the same direction as shown in FIG. 16. The heater unit shown in FIGS. 18(*a*) and 18(*b*) is obtained by mounting a PTC sheet unit 11 bonded to a metal cover 15 in an outer frame case 12 with an adiabatic material 14 filled therebetween. In this case, the PTC sheet unit 11 has two PTC ceramics from which lead wires 7 are taken out in the same direction. The lead wires 7 can be easily bonded to lead wire bonding portions 13 which are connected to main body power supply connection portions 9. Thus, there is an advantage in that the heater unit are made compact and in that the possibility of failures and accidents is reduced.

Figure 19:
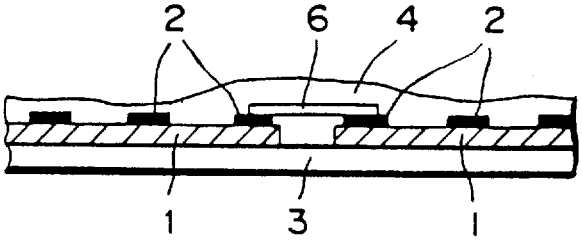
FIG. 19 is a sectional view of a PTC planar unit having an overcurrent fusing portion according to the present invention.
Figure 22:
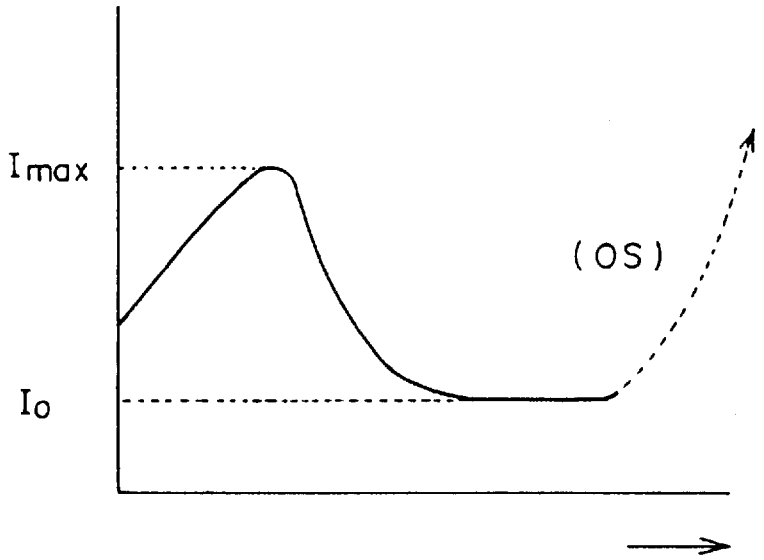
FIG. 22 PRIOR ART
FIG. 22 illustrates the transition of a current through a PTC heater unit.

FIG. 19 shows a possible cross-sectional structure of an overcurrent fusing portion 6 wherein the overcurrent fusing portion 6 is coated with an insulation film 4. Such a structure increases the amount of heat transferred to the insulation coating or insulation plate on the surface. As a result, the temperature rise at the overcurrent fusing portion is delayed accordingly, which in turn causes a time-lag in the fusing action against an overcurrent. Further, there will be variation in the fusing position and the fusing current. This will make the operation unstable and necessitate a higher fusing current. In order to avoid this, a structure as shown in FIGS. 20(*a*), 20(*b*), and 20(*c*) is employed wherein a space 16 is provided around the overcurrent fusing portion 6. In FIG. 20(*a*), no surface insulation film is provided on the overcurrent fusing portion 6, and the space 16 is provided between a bottom of the fusing portion 6 and the insulation film 4. In FIG. 20(*b*), the insulation film 4 is provided so that the space 16 is left around the overcurrent fusing portion 6. In FIG. 20(*c*), the overcurrent fusing portion 6 is covered by an insulation substrate 5 with a metal cover plate 15 interposed therebetween to provide the space 16. The space 16 eliminates any delay in the temperature rise at the overcurrent fusing portion and, consequently, any time-lag in the fusing action against an overcurrent. Further, it eliminates variation in the fusing position and fusing current, thereby allowing stable operations A PTC planar heater according to the present invention can be used in applications related to aircraft, aerospace, automobile, shipping industries and the like, wherein a heater must provide high output with a limited weight.

We claim:

1. A PTC planar heater comprising:

an electrically insulating substrate;

a plurality of PTC ceramic sheets, each having a pair of electrodes formed thereon, said plurality of PTC ceramic sheets being bonded to said electrically insulating substrate; and said pairs of electrodes being connected in parallel such that electrodes of said pairs of electrodes having a same polarity are connected.

2. The PTC planar heater according to claim 1, further comprising an electrically insulating elastic layer formed on a surface on which the electrodes are formed.

3. The PCT planar heater according to claim 1, wherein a thickness of the PTC ceramic sheets is equal to or greater than 0.5 mm.

4. A method for adjusting a resistance of a PTC planar heater having a plurality of PTC ceramic sheets each having a pair of electrodes, the method comprising the steps of:

measuring a resistance across the electrodes of each of the PTC ceramic sheets of the PTC planar heater; and cutting the electrodes to shorten conductive paths thereof in accordance with said measured resistance.

5. A method for adjusting a resistance of a PTC planar heater comprising the steps of:

forming two or more electrodes on a surface of a PTC ceramic sheet of said PTC planar heater with gaps in plural positions dividing individual ones of said electrodes into more than one section;

measuring a resistance across said two or more electrodes; and forming electrical connection members across selected ones of said gaps in accordance with said measured resistance.

6. A method for adjusting a resistance of a PTC planar heater comprising the steps of:

forming two or more electrodes on one side of a PTC ceramic sheet of said PTC planar heater;

forming a common electrode on a side of said PTC ceramic sheet opposite said one side; and setting a distance between a pair of said two or more electrodes during said formation thereof in accordance with a desired resistance value.

7. A method for adjusting a resistance of a PTC planar heater comprising the steps of:

forming at least one common electrode on one side of a PTC ceramic sheet of said PTC planar heater;

forming two or more electrodes on a side of said PTC ceramic sheet opposite said one side;

measuring a resistance across a pair of said two or more electrodes; and cutting said at least one common electrode to form one of a gap across said at least one common electrode and a notch in said at least one common electrode in accordance with said measured resistance.

8. A method for adjusting the resistance of a PTC planar heater comprising the steps of:

forming at least one common electrode on one side of a PTC ceramic sheet of said PTC planar heater with one of a gap across said at least one common electrode and a notch extending partially across said at least one common electrode;

forming two or more electrodes on a side of said PTC ceramic sheet opposite said one side;

measuring a resistance across a pair of said two or more electrodes; and forming an electrical connection member across said one of said gap and said notch in said at least one common electrode in accordance with said measured resistance.

9. The method for adjusting a resistance of a PTC planar heater according to claim 5, claim 7, or claim 8 wherein the electrical connection member is formed using one of soldering, brazing, a conductive adhesive, flame spraying, and welding.

10. A PTC planar unit comprising:

a PTC thermistor element having a pair of electrodes formed on a first side and an electrically insulating substrate bonded on top of said pair of electrodes; and another electrically insulating substrate is mounted on a second side of said PTC thermistor element which is opposite said first side.

11. The PTC sheet unit, comprising:

at least two PTC sheets each having a pair of vortex-shaped electrodes formed on a first surface thereof and each having a second surface mounted on an electrically insulating substrate; and at least one overcurrent fusing element interconnecting one of said pair of vortex-shaped electrodes of one of said at least two PTC sheets and one of said pair of vortex-shaped electrodes of another one of said at least two PTC sheets.

12. The PTC sheet unit according to claim 11, wherein a space is provided around the overcurrent fusing element to prevent a delay in fusing.

* * * * *